US007811426B2

(12) United States Patent
Hashimoto et al.

(10) Patent No.: US 7,811,426 B2
(45) Date of Patent: Oct. 12, 2010

(54) OXYGEN EVOLUTION ELECTRODE

(75) Inventors: Koji Hashimoto, 25-2, Shogen 2-chome, Izumi-ku, Sendai, Miyagi-ken (JP); Ahmed Abd El-Moneim, Giza (EG); Naokazu Kumagai, Chiba-ken (JP)

(73) Assignees: Daiki Ataka Engineering Co., Ltd., Tokyo (JP); Koji Hashimoto, Sendai (JP)

( * ) Notice: Subject to any disclaimer, the term of this patent is extended or adjusted under 35 U.S.C. 154(b) by 511 days.

(21) Appl. No.: 11/976,510

(22) Filed: Oct. 25, 2007

(65) Prior Publication Data

US 2008/0116064 A1 May 22, 2008

(51) Int. Cl.

| | |
|---|---|
| ***C25B 11/16*** | (2006.01) |
| ***C25B 11/06*** | (2006.01) |
| ***C25B 11/08*** | (2006.01) |
| ***C25B 11/04*** | (2006.01) |

(52) U.S. Cl. ..... 204/290.13; 204/290.01; 204/290.03; 204/290.06; 204/290.08; 204/290.09; 204/290.12; 204/290.14

(58) Field of Classification Search ..... 204/290.01, 204/290.03, 290.08, 290.09, 290.12, 290.13, 204/290.14

See application file for complete search history.

(56) References Cited

U.S. PATENT DOCUMENTS

| | | | | |
|---|---|---|---|---|
| 4,285,799 | A * | 8/1981 | de Nora et al. | 204/290.09 |
| 4,289,591 | A * | 9/1981 | Davidson et al. | 205/634 |
| 2008/0035491 | A1 * | 2/2008 | Ohta et al. | 205/551 |

* cited by examiner

*Primary Examiner*—Bruce F Bell
(74) *Attorney, Agent, or Firm*—Edwards Angell Palmer & Dodge LLP

(57) ABSTRACT

Disclosed is an oxygen evolution anode for evolving oxygen without chlorine evolution in electrolysis of aqueous solutions of sodium chloride having high performance and durability with decreased amount of the precious metal(s) in the intermediate layer to decrease manufacturing cost and to ease problem of the resources. The oxygen evolution anode comprises an electroconductive substrate, an intermediate layer and an electrocatalyst. The intermediate layer prepared by calcination consists of multiple oxide of the platinum group element(s), Sn and Sb, with the Sn/Sb ratio of 1-40 and with the sum of Sn and Sb of 90 cationic % or less. The electrocatalyst is prepared by anodic deposition and consists of 0.1-3 cationic % of Sn, 0.2-20 cationic % of Mo and/or W and the balance of Mn.

1 Claim, No Drawings

OXYGEN EVOLUTION ELECTRODE

BACKGROUND OF THE INVENTION

1. Field in the Industry

The present invention concerns an anode for oxygen evolution without forming chlorine in electrolysis of chloride-containing aqueous solutions including seawater.

2. Prior Art

In general, seawater electrolysis is performed to produce sodium hypochlorite by the reaction of chlorine formed on the anode with sodium hydroxide formed on the cathode in addition to the formation of hydrogen on the cathode. For this purpose, there has been used anodes made by coating titanium with an oxide of an element or elements of the platinum group (hereinafter referred to as "platinum group element(s)) as the high performance electrodes.

On the other hand, like fresh water electrolysis to produce hydrogen and oxygen, for production of hydrogen and oxygen in seawater electrolysis, formation of hydrogen on the cathode and formation of oxygen on the anode without formation of chlorine are prerequisite, and hence, a special anode is required.

The inventors found the fact that the oxide electrodes prepared by repeated coating of Mn salt solution together with Mo salt and/or W salt on a conducting substrate and subsequent calcination at high temperatures in air was active as an anode for oxygen evolution in electrolysis of sodium chloride solutions but inactive for chlorine evolution, and disclosed it (Japanese patent Disclosure No. 09-256181). There are two types in this kind of electrodes:

(1) The electrode wherein an electroconductive substrate is coated with the oxide containing 0.2-20 cationic % of Mo and/or W and the balance of Mn.

(2) The electrode wherein an electroconductive substrate is coated with the oxide containing 0.2-20 cationic % of Mo and/or W, and 1-30 at % of Zn and the balance of Mn and wherein the effective surface area of the electrode is increased by leaching out Zn by immersion in hot concentrated alkali solution.

The above-described previous invention is based on the findings that, in production of oxygen evolution anode, calcination of Mn salt coated on the electroconductive substrate leads to formation of $Mn_2O_3$ and that inclusion of Mo and/or W in $Mn_2O_3$ enhances the oxygen evolution efficiency. In production of oxygen evolution anode, if the calcination temperature is not sufficiently high, stability of the electrode is insufficient due to insufficient crystal growth, but even at high temperatures Mn cannot be oxidized to such a high valence as three or higher because of decomposition of high valence Mn oxide.

Nevertheless, higher valent Mn oxide is expected to have higher activity for oxygen evolution. Thus, an attempt to form Mn oxide by anodic deposition from divalent Mn salt solution was made and gave rise to formation of highly active anode consisting of tetravalent Mn. This finding was also disclosed (Japanese Patent Disclosure No. 10-287991). The electrode based on this finding consists of the electroconductive substrate coated with the oxide containing 0.2-20 cationic % of Mo and/or W, and the balance of Mn, and is characterized in that these oxide are formed by anodic deposition.

Subsequently, the inventors made the following inventions and the inventions were disclosed. They concern the electrolytic cell using the above-described anode (Japanese Patent Disclosure No. 11-256383), the electrode assembly using combination of the electrode and a diode (Japanese Patent Disclosure No. 11-256384) and a method of producing the anode (Japanese Patent Disclosure No. 11-256385), Furthermore, the inventors found that the electrode in which Fe is added to Mn—Mo, Mn—W or Mn—Mo—W oxide was effective as oxygen evolution anode in the solutions containing chloride ion in a wide temperature range up to just below the boiling point of water, (Japanese Patent Disclosure No. 2003-19267). Another patent application was filed for the modified technology of producing the anode including the preparation method of the titanium substrate (Japanese Patent Disclosure No. 2007-138254).

Further research resulted in the finding that addition of Sn to anodically deposited Mn—Mo and/or W oxide improved the activity and durability of the anode, and another patent application was filed in regard to the finding. According to the invention, the anodically deposited oxide consist of 0.2-20 cationic % of Mo and/or W, in which 0.1-3 mol % thereof is substituted with Sn, and the balance of Mn. The anode thus formed showed high performance for oxygen evolution in aqueous solutions containing chloride ion.

In these anodes titanium is used as the electroconductive substrate on which the electroactive catalysts containing Mn are coated. In order to avoid growth of insulating titanium oxide during electroactive catalyst formation by calcination or by anodic deposition and during anodic polarization in electrolysis of chloride-containing aqueous solutions, there has been used electroconductive substrates made of titanium coated with an intermediate layer of the oxide of the platinum group element(s). Formation of the intermediate layer with a sufficient thickness is carried out by repeated coating of a butanol solution containing salt or slats of the platinum group element(s) and subsequent drying followed by calcination in air. Such an electrode made by coating titanium with oxide or oxide of the platinum group element(s) is known as dimensionally stable anode and has been used as the anode for electrolysis and electrodeposition.

For utilization of hydrogen energy, hydrogen production by electrolysis of solutions containing chloride ion without forming chlorine on the anode requires oxygen evolution anodes. However, massive production of hydrogen will result in consumption of a large amount of anode material using intermediate oxide layer of the platinum group element(s). This may cause a problem because of limited resources. Thus, the active electrodes with smaller consumption of the platinum group element(s) are demanded.

The inventors, in view of the preferable characteristics for the coating layer on the titanium substrate that it has the same rutile structure as $TiO_2$ and is stable without being dissolved even under highly oxidizing condition of anodic polarization, and noted that an oxide of tin, $SnO_2$, has the same rutile structure as $TiO_2$ and is stable without dissolution under highly oxidizing condition, hit upon an idea of using $SnO_2$ together with the oxide of the platinum group element(s) in the intermediate layer. Although the electronic conductivity of $SnO_2$ is not sufficiently high, this problem was overcome by the inventors' discovery that the electronic conductivity can be enhanced by addition of Sb, and hence, that it is advisable to use Sn together with Sb.

The electrode based on the above-described idea and discovery consists of a titanium substrate and multiple oxide of the platinum group=element(s), and Sb and Sn. The electrode having the multiple oxide as the electrocatalyst can be used in various electrochemical reactions such as electrolysis and electrodeposition.

More specifically, the electrode according to the invention is an anode used for electrochemical reactions made by coating an electroconductive substrate of titanium with a layer of metal oxide as the electrocatalyst, in which the metal oxide consist of multiple oxide of Sn and Sb, and the platinum group element(s). In this anode the cationic Sn/Sb ratio is in the range of 1-40, and the sum of Sn and Sb in the electrocatalyst is 90 cationic % or less, preferably 1-70 cationic %, and the balance of the oxide of the platinum group element(s). A separate patent application covering this invention was filed.

SUMMARY OF THE INVENTION

The objective of the present invention based on the recent knowledge of the inventors is to provide an oxygen evolution anode made by coating an electroconductive substrate such as titanium with an intermediate layer consisting of precious metal oxide and forming an electrocatalyst consisting of oxide of Mn and Mo and/or W thereon, in which necessary amount of the precious metal(s) in the intermediate layer is decreased so as to lower the manufacturing cost and to mitigate shortage of the precious metal resources, and at the same time to realize improvement in the performance and durability of the electrocatalyst.

The oxygen evolution electrode of the present invention is an electrode made by forming on a substrate an intermediate layer and an electrocatalyst layer in this order and is used for evolving oxygen without chlorine formation in electrolysis of aqueous solution containing chloride ion, in which the intermediate layer prepared by calcinations consists of multiple oxide of the platinum group element(s), Sn and Sb with the Sn/Sb ratio of 1-40 and with the sum of Sn and Sb of 90 cationic % or less, and the electrocatalyst prepared by anodic deposition consists of 0.1-3 cationic % of Sn, 0.2-20 cationic % of Mo and/or W and the balance of Mn as the main component.

DETAILED EXPLANATION OF PREFERRED EMBODIMENT

An example of preparation of the electrode according to the present invention is as follows: Corrosion resistant titanium is suitable for the conductive substrate of the electrode because it is exposed to highly oxidizing environment. The substrate is subjected to treatments for removing the air-formed oxide film by acid washing and for surface roughening by etching to enhance adhesion of the electrocatalyst. The titanium substrate is then coated by repeated brushing of the solution such as butanol solution of adequate concentrations of salt(s) of platinum group element(s), and Sn and Sb, and subsequent drying followed by calcinations at 550° C. By these procedures, the electrode with the electrocatalyst of multiple oxide consisting of Sn, Sb and one or more of platinum group elements is prepared.

The reasons why the composition of the intermediate layer was defined as above are explained below: The platinum group element(s) are the basic component of the intermediate layer of the present invention, and Ru, Rh, Pd, Os, Ir, Pt form $MO_2$ type oxide by heat treatment in air. These oxide except $PtO_2$ have the same rutile structure as $TiO_2$ and $SnO_2$, and form solid solution with them. The lattice constants of "a"-axis and "c"-axis of $PtO_2$ are quite close to those of $TiO_2$ and $SnO_2$, and hence, $PtO_2$ forms a single phase oxide with $TiO_2$ and $SnO_2$.

Because the oxide of [platinum group element(s) —Sn—Sb] forming the intermediate layer are multiple oxide of single phase, and hence, for formation of the single phase oxide the compositions can be chosen arbitrarily. It is desirable to decrease the amount(s) of platinum group element(s) by increasing the relative amounts of Sn and Sb thereto so as to decrease the cost and to save the resources. However, excess addition of Sn and Sb lowers the performance of the electrodes, and hence, the sum of Sn and Sb in the oxide constituting the intermediate layer should be 90 cationic % or less, preferably, 70 cationic % or less. On the other hand, if the sum of Sn and Sb in the oxide constituting the intermediate layer is less than 1 cationic %, the electrode is not superior to the electrodes with only platinum oxide as the intermediate layer, and hence, the sum of Sn and Sb in the oxide should be 1 cationic % or more. The suitable sum of Sn and Sb is in the range of 1-70 cationic % and the most suitable sum is in the range of 30-60 cationic %

Sb is added to enhance the electric conductivity that is insufficient in multiple oxide consisting only of platinum group element(s) and Sb. If Sb is added in such amount that the cationic Sn/Sb ratio is 40 or lower, the oxide formed have sufficient electric conductivity, and hence, the Sn/Sb ratio is chosen to be 40 or lower. However, excess addition of Sb rather decreases the electric conductivity, and hence, the added Sb should be at such a level that the cationic Sn/Sb ratio may be unity or more.

The formation of electrocatalyst by anodic deposition can be carried out on the thus prepared substrate in a heated electrolytic solution of $MnSO_4$—$SnCl_4$ with $Na_2MoO_4$ and/or $Na_2WO_4$, the pH of which is adjusted by addition of sulfuric acid. The oxygen evolution electrode, the electrocatalyst of which is multiple oxide of Mn—Mo—Sn, Mn—W—Sn or Mn—Mo—W—Sn, is thus obtained.

The reason why the composition of the multiple oxide electrocatalyst is defined above is as follows:

Mn is the basic component of the multiple oxide electrode of the present invention and forms $MnO_2$ which takes the role of forming oxygen in seawater electrolysis Mo and W themselves do not form oxide with sufficiently high activity for oxygen evolution, but coexistence of Mo and/or W with $MnO_2$ prevents chlorine evolution and enhances oxygen evolution in addition to prevention of oxidation of Mn to soluble permanganate ion. This effect cannot be obtained unless at least 0.2 cationic % of Mo and/or W is contained in the multiple oxide. However, excess addition of Mo and/or W decreases the oxygen evolution efficiency, and hence, the cationic % of Mn and/or W must be 20 or less.

Sn increases oxygen evolution activity and durability of the electrode by constituting the multiple oxide with Mn and W and/or Mo. This effect appears with the addition of 0.1 cationic % or more of Sn, and increases at a higher Sn content. However, excess addition of Sn rather decreases the oxygen evolution efficiency, and hence, the content of Sn is limited to be at highest 3 cationic %.

In the oxygen evolution electrode of the present invention the intermediate layer contacting electroconductive substrate made of titanium is multiple oxide layer of $SnO_2$ and $MO_2$ (M is platinum group element(s)) of the same rutile structure as $TiO_2$, and hence, prevents continuously formation of insulating oxide film on the titanium substrate. Furthermore, because of the smaller amount of platinum group element(s) in the intermediate layer, the manufacturing cost is low and the problem of the resources is mitigated. In addition, in the oxygen evolution electrode of the present invention, the electrocatalyst layer on the intermediate layer is multiple oxide layer of Mn—Mo and/or W—Sn—Sb, and the electrode performance is improved in comparison with the electrode with multiple oxide of Mn—Mo and/or W only. The life of the electrode is significantly prolonged due to prolonged function of the intermediate layer and enhanced durability of the electrocatalyst.

EXAMPLES

Example 1

A titanium mesh made by punching a plate was immersed in 0.5 M HF solution for 5 min. to remove the surface oxide film, and then, subjected to etching in 11.5 M $H_2SO_4$ solution at 80° C. to increase the surface roughness until hydrogen evolution ceased due to the coverage of the surface with titanium sulfate. Titanium sulfate on the titanium surface was washed away by flowing tap water for about 1 hr. Just before coating the intermediate layer the titanium mesh was ultrasonically rinsed in deionized water.

The above titanium mesh with the effective surface area of 20 $cm^2$ was coated by brushing mixed butanol solutions of 4.0 ml of 5 M $K_2IrCl_6$, 5.33 ml of 5 M $SnCl_4$ and 0.67 ml of 5 M $SbCl_6$, dried at 90° C. for 5 min. and calcinated for conversion to oxide at 550° C. for 10 min. The procedures were repeated until the weight of oxide increased to 45 $g/m^2$. The electrode substrate was obtained by final calcination at 550° C. for 60 min. The cationic composition of the intermediate layer thus formed was determined by EPMA. The cationic %'s of Ir, Sn and Sb in the electrocatalyst layer were 65.0, 28.5 and 6.5%, respectively.

A mixed solution of the composition of 0.2 M $MnSO_4$-0.003 M $Na_2MoO_4$-0.006 M $SnCl_4$ was prepared, and the pH was adjusted to −0.1 by addition of sulfuric acid, and the solution was warmed to 90° C. Using the Ir—Sn—Sb triple oxide-coated titanium substrate as anode anodic deposition was carried out in the above electrolysis mixed solution at the current density of 600 $A/m^2$ for 60 min.

Using the electrode thus prepared electrolysis was carried out in 0.5 M NaCl solution of pH 8.7 at 1000 $A/m^2$ for 1000 Coulombs, and then the chlorine evolution efficiency was analyzed by iodimetric titration. No chlorine evolution was detected with a consequent 100% oxygen evolution efficiency. Even after electrolysis for 1400 h in the above-mentioned solution the oxygen evolution efficiency was 98% or higher. It was ascertained that the electrode of the present invention has high activity for oxygen evolution and excellent durability.

Example 2

The same surface treatments as in Example 1, i.e., removal of the surface film, etching for surface roughening, rinsing with water and ultrasonic rinsing were applied to other punched titanium meshes of the effective surface area of 20 $cm^2$, and the resulting mesh was used as the anode substrate.

Respective 5 M butanol solutions of $RuCl_3$, $RhCl_3$, $PdCl_3$, $OsCl_3$, $K_2IrCl_6$ and $K_2PtCl_6$ were prepared as the materials of the platinum group elements. Using mixed solutions of different mixed ratios of the above 5 M precious metal butanol solutions and 5 M $SnCl_4$ and 5 M $SbCl_6$ butanol solutions, the titanium meshes were coated by repeated brushing of the mixed solutions, drying at 90° C. for 5 min. and calcination for conversion to oxide at 550° C. for 10 min. until the weight of oxide increased to 45 $g/m^2$. Substrates of the electrode were obtained by final calcination at 550° C. for 60 min. The cationic compositions of the intermediate layers thus formed were determined by EPMA. The results are shown in Table 1.

To a mixed solution of 0.2 M $MnSO_4$-0.003 M $Na_2MoO_4$-0.006 M $SnCl_4$ sulfuric acid was added to adjust pH of the solution to −0.1, and the solution was warmed to 90° C. Anodic deposition was carried out in this solution using the titanium substrate coated with the intermediate layer as the anode for 60 min.

Using the electrodes on which multiple oxide layer of Mn—Mo—Sn was formed by anodic deposition as the anode, the electrolysis was carried out in 0.5 M NaCl solution of pH 8.7 at current density of 1000 $A/m^2$ for 1000 Coulombs, and then, an attempt was made to obtain the oxygen evolution efficiency from the difference between the amount of charge passed and the amount of chlorine formation obtained by iodimetric titration. No chlorine evolution was detected, and thus, all the electrodes showed 100% oxygen evolution efficiency as shown in Table 1. It is, therefore, concluded that the electrode of the present invention is highly active for oxygen evolution as the anode in the electrolysis of solutions containing chloride ion.

TABLE 1

| | Cationic % in Intermediate Multiple Oxide | | | | | | | | Oxygen Evolution Efficiency |
|---|---|---|---|---|---|---|---|---|---|
| No. | Ru | Rh | Pd | Os | Ir | Pt | Sn | Sb | (%) |
| 1 | 49 | | | | | | 42 | 9 | 100 |
| 2 | 12 | | | | | | 78 | 10 | 100 |
| 3 | 98.5 | | | | | | 1 | 0.5 | 100 |
| 4 | | 99 | | | | | 0.6 | 0.4 | 100 |
| 5 | | 46 | | | | | 43 | 11 | 100 |
| 6 | | 11 | | | | | 56 | 33 | 100 |
| 7 | | | 98 | | | | 1.5 | 0.5 | 100 |
| 8 | | | 95.1 | | | | 2.5 | 2.4 | 100 |
| 9 | | | 52 | | | | 31 | 17 | 100 |
| 10 | | | 12 | | | | 59 | 29 | 100 |
| 11 | | | | 98.6 | | | 1.1 | 0.3 | 100 |
| 12 | | | | 51 | | | 31 | 18 | 100 |
| 13 | | | | 11 | | | 64 | 25 | 100 |
| 14 | | | | | 95 | | 4 | 1 | 100 |
| 15 | | | | | 11 | | 84 | 5 | 100 |
| 16 | | | | | 11 | | 88 | 1 | 100 |
| 17 | | | | | | 97.7 | 1.2 | 1.1 | 100 |
| 18 | | | | | | 64 | 21 | 15 | 100 |
| 19 | | | | | | 10.4 | 74 | 15.6 | 100 |

Example 3

The same surface treatments as in Example 1, i.e., removal of the surface film, etching for surface roughening, rinsing with water and ultrasonic rinsing were applied to the punched titanium of the effective surface area of 20 $cm^2$.

The above titanium meshes were coated by brushing with mixed butanol solutions of different mixed ratios of 5 M $K_2IrCl_6$, 5 M $SnCl_4$ and 5 M $SbCl_6$, dried at 90° C. for 5 min. and calcined for conversion to oxide at 550° C. for 10 min. The procedures were repeated until the weight of the oxide increased to 45 $g/m^2$. Substrates of the electrode were obtained by final calcination at 550° C. for 60 min. The cationic compositions of the intermediate layers thus formed were determined by EPMA. The cationic % of Ir, Sn and Sb are shown in Table 2.

The anodic deposition was carried out in an electrolytic solution of the composition of 0.2 M $MnSO_4$-0.003 M $Na_2MoO_4$-0.006 M $SnCl_4$ solution, the pH of which was adjusted to −0.1 by addition of sulfuric acid, and warmed to 90° C., on the above-prepared anode with the intermediate layer of the oxides at a current density of 600 $A/m^2$.

Using the thus prepared electrodes having Mn—Mo—Sn triple oxide layer on the surface, the electrolysis was carried out in 0.5 M NaCl solution of pH 8.7 at 1000 $A/m^2$ for 2420 h, and subsequently, another electrolysis was carried out in 0.5 M NaCl solution of pH 8.7 at 1000 $A/m^2$ for 1000 Coulombs to determine chlorine evolution. The oxygen evolution efficiency was calculated on the difference between the amount of charge passed and that of chlorine formation obtained by iodimetric titration. The results are shown in Table 2. It has been ascertained that the electrode of the present invention maintains high oxygen evolution efficiency for a long period of time in the electrolysis of the solution containing chloride ion.

TABLE 2

| | Cationic % of intermediate multiple oxide layer | | | Oxygen Evolution Efficiency after Electrolysis for 2420 h |
|---|---|---|---|---|
| No. | Ir | Sn | Sb | (%) |
| 20 | 36.8 | 51.3 | 11.9 | 97.63 |
| 21 | 46.6 | 40.8 | 12.6 | 97.23 |
| 22 | 60.0 | 30.6 | 9.4 | 97.23 |
| 23 | 65.6 | 29.3 | 5.1 | 97.43 |
| Control Example | 100 | 0 | 0 | 92.99 |

We claim:

1. An oxygen evolution electrode for evolving oxygen without chlorine formation in electrolysis of aqueous solutions containing chloride ion, which is prepared by depositing an intermediate layer and an electrocatalyst layer in this order on an electroconductive substrate made of titanium;

wherein the intermediate layer, which is prepared by calcination, consists of multiple oxide of an element or elements of the platinum group, Sn and Sb with the Sn/Sb cationic ratio of 1-40, in which the sum of Sn and Sb shares 90 cationic % or less of the multiple oxide and the balance is the oxide of the element or elements of the platinum group; and wherein cations of the electrocatalyst layer, which is prepared by anodic deposition, consists of 0.1-3 cationic % of Sn, 0.2-20 cationic % of Mo and/or W, and the balance of Mn.

* * * * *